US006115984A

United States Patent [19]

Paradis

[11] Patent Number: 6,115,984

[45] **Date of Patent: *Sep. 12, 2000**

[54] FLEXIBLE RUNNER

[76] Inventor: Yvon Paradis, 3371 Soissons, Longueuil, Québec, Canada, J4L 3M3

[ * ] Notice: This patent issued on a continued prosecution application filed under 37 CFR 1.53(d), and is subject to the twenty year patent term provisions of 35 U.S.C. 154(a)(2).

[21] Appl. No.: 08/942,003

[22] Filed: Oct. 1, 1997

[51] Int. Cl.[7] ..... E04G 11/06

[52] U.S. Cl. ..... 52/717.03; 52/247; 52/717.06; 52/86; 52/631; 52/481.1

[58] Field of Search ..... 52/245, 247, 717.03, 52/717.06, 85, 86, 745.07, 631, 486.1, 482, 781

[56] References Cited

U.S. PATENT DOCUMENTS 2,163,613 6/1939 Manofsky ..... 52/85
3,706,173 12/1972 Taylor ..... 52/717.03
4,055,922 11/1977 Ellington et al. ..... 52/245 X
5,816,002 10/1998 Bifano et al. ..... 52/85 X

FOREIGN PATENT DOCUMENTS 453415 10/1991 European Pat. Off. ..... 52/245

*Primary Examiner*—Carl D. Friedman
*Assistant Examiner*—Brian E. Glessner

[57] ABSTRACT

A runner for maintaining at least two studs in a predetermined relationship relatively to one another so as to allow for the construction walls presenting a laterally curved portion, walls erected in a space where the distance between a floor and a ceiling varies or half walls having a figured upper end. Each runner includes at least two stud receiving components. Each of the stud receiving components is configured and sized for receiving one of the stud end portions. Each stud receiving component is provided with a linking structure mounted thereon for mechanically linking with an adjacent stud receiving component while allowing the linked stud receiving components to be angled relatively to each other. Each stud receiving component has a generally "U"-shape.

18 Claims, 3 Drawing Sheets

FLEXIBLE RUNNER

FIELD OF THE INVENTION

The present invention relates to the field of construction material and is particularly concerned with a flexible runner used in the construction of partition walls.

BACKGROUND OF THE INVENTION

The construction of the framing of partition walls has traditionally been carried out according to the following sequence: a first piece of lumber (usually a 2"×4" lumber) to be used as a floor runner is secured to the floor where the interior wall is to be erected, a second piece of lumber (also a 2"×4" lumber) to be used as a ceiling runner is secured to the ceiling directly above the first piece of lumber, a plurality of studs are erected between the first and second pieces of lumber, the studs are carefully aligned with the runners and secured thereto via nails while retaining their alignment with the runners.

One major drawback of the above described use of pieces of lumber as floor and ceiling runners is the time consuming step of aligning the studs with the runner and the relative difficulty of keeping that alignment during the securing step.

To avoid the above mentioned drawback, It has been proposed to replace the floor and ceiling lumber runners by U-shaped channels made of galvanised steel. These U-shaped runners are sized to receive conventional wood studs or to receive metallic studs.

Even though the above mentioned use of U-shaped channels as floor and ceiling runners speeds up the erection of interior walls frames, a major drawback remains: the U-shaped channel runners are not suited to construct walls presenting a laterally curved portion, walls erected in a space where the distance between a floor and a ceiling varies or half walls having a figured upper end.

SUMMARY OF THE INVENTION

An object of the present invention is therefore to provide an improved runner free of the above mentioned drawbacks of the prior art.

In accordance with one aspect of the invention, there is provided a runner for maintaining at least two studs in a predetermined relationship relatively to one another, each of the studs having a generally elongated configuration defining a pair of longitudinally opposed stud end portions, the runner comprising: at least two stud receiving components, each of the stud receiving components being configured and sized for receiving one of the stud end portions; each stud receiving component being provided with a linking means mounted thereon for mechanically linking with an adjacent stud receiving component while allowing the linked stud receiving components to be angled relatively to each other.

Preferably, at least one of the at least two stud receiving components has a generally concave configuration.

Conveniently, the at least one stud receiving component has a generally "U"-shaped cross-sectional configuration defining a base wall, the base wall having a base wall peripheral edge; the at least one stud receiving component further having a pair of retaining flanges extending substantially perpendicularly from opposite sides of the base wall peripheral edge.

Preferably, the base wall has a generally rectangular and flat configuration defining a pair of opposed longitudinal edges and a pair of perpendicularly oriented transversal edges the retaining flanges extending integrally from the transversal edges.

Conveniently, each of the retaining flanges has a proximal edge merging with one of the transversal edges, an opposed distal edge and a pair of side edges extending between the proximal edge and the distal edge.

Preferably, each side edge defines a side edge perpendicular segment and an integrally extending side edge angled segment; each side edge perpendicular segment extending substantially perpendicularly from the base wall while each side edge angled segment extends at an angle from the adjacent side edge perpendicular segment inwardly towards an opposed side edge angled segment part of the same retaining flange.

Conveniently, the linking means includes a membrane extending between adjacent stud receiving component.

Preferably, the linking means includes a base strip extending between base walls part of adjacent stud receiving components.

Conveniently, the linking means includes a pair of flange strips extending between retaining flanges part of adjacent stud receiving components.

Preferably, the linking means includes a base strip extending between base walls part of adjacent stud receiving components and also includes a base strip extending between base walls part of adjacent stud receiving components.

Conveniently, the base strips extend between the longitudinal edges of adjacent base walls while the flange strips extend between the side edge perpendicular segments adjacent the side edge angled segments of adjacent retaining flanges.

Preferably, the membrane is configured, sized and made out of a suitable material so as to allow selective bending thereof when subjected to a predetermined bending force so that the predetermined bending force is necessary for modifying the configuration of the membrane.

Conveniently, either or both the base strips and the flange strips are made of a generally rectangular configuration that is inwardly bent about a fold line so as to define a generally "V"-shaped cross sectional configuration.

Preferably, either or both the base strips and the flange strips have a thickness substantially in the range of 1/16", a width substantially in the range of 3/4", a length substantially in the range of 1" and are made of galvanized steel.

Conveniently, the stud receiving components and the linking means are integrally formed of a strip of precut and folded material.

Preferably, the intersections of the retaining flanges with the side edge angled segment forms an obstructing structure; whereby the abutment structure is used for matingly configuring a pair of jointly working runners.

Conveniently, at least one of the retaining flanges has a fixing aperture extending therethrough.

In accordance with another aspect of the invention, there is provided a blank used for forming two contiguous stud receiving components part of a runner, the blank comprising: a flat sheet of material having a generally rectangular configuration, the flat sheet being divided into a pair of symmetrical half sections by a central longitudinal fold line; a lateral longitudinal fold line extending in a parallel and substantially contiguous relationship to the central longitudinal fold line on each side of the latter; the lateral longitudinal fold lines defining a central area; the central area being provided with a pair of rectangular aperture extending therethrough in a symmetrically spaced relationship relative to each other; the longitudinal edges of the rectangular apertures being in register with the lateral longitudinal fold lines; a transversal fold line extending transversally across the flat sheet and intercepting the rectangular apertures.

In accordance with the invention there is also provided a runner for receiving studs for forming a partition wall frame, each the studs including longitudinally opposed end portions, the runner comprising: at least two stud receiving elements; each the stud receiving elements being so configured and sized as to receive an end portion of the studs; interconnecting means for interconnecting consecutive stud receiving elements; the interconnecting means allowing the consecutive stud receiving elements to be positioned according to a predetermined relationship, and the consecutive stud receiving elements to maintain the predetermined relationship.

Advantages of the present invention include that the flexible runners allow for the easy and ergonometric mounting of wall structures having a generally arcuate configuration.

The present invention also allows for easy and ergonometric formation of apertures such as window apertures having a generally arcuate configuration.

Furthermore, the present invention conforms to conventional forms of manufacturing is of simple construction and easy to use so as to provide a runner that ids economically feasible, long lasting and relatively trouble free in operation.

Other objects and advantages of the present invention will become more apparent to one skilled in the art upon reading of the following non-restrictive description of a preferred embodiment thereof, given by way of example only with reference to the appended drawings.

BRIEF DESCRIPTION OF THE DRAWINGS

An embodiment of the present invention will now be described in reference to the following drawings in which.

Similar reference numerals are used in similar views to denote similar components.

DETAILED DESCRIPTION

Figure 6:
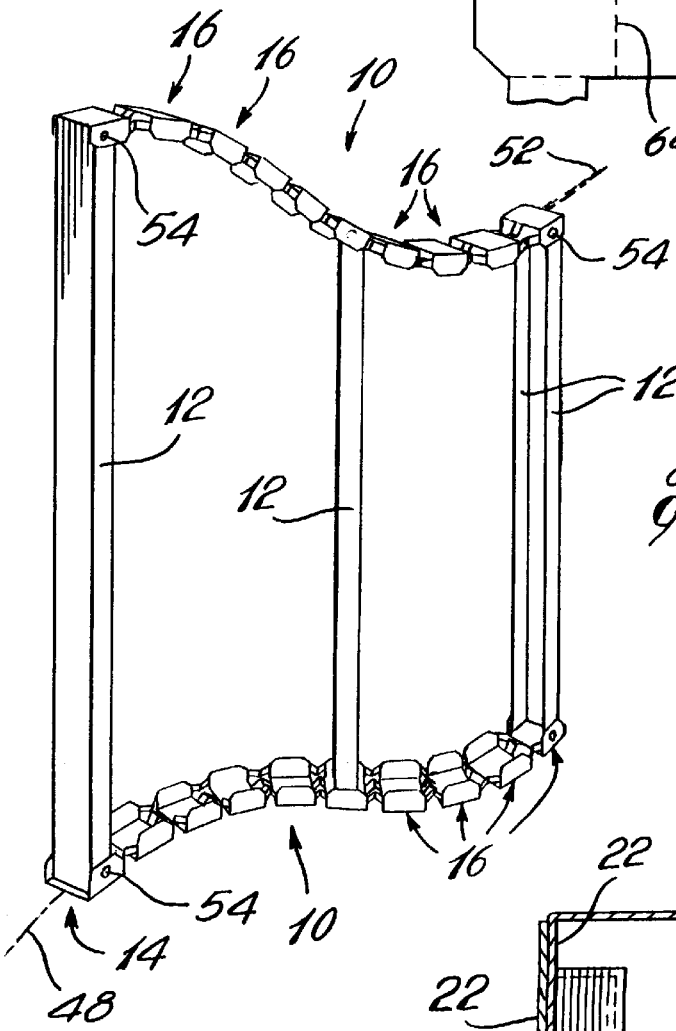
FIG. 6: in a perspective view illustrates part of a curved partition wall being formed by a set of studs mounted on a pair of runners in accordance with an embodiment of the present invention.

Referring to FIG. 6, there is shown a pair of runners 10 both in accordance with an embodiment of the present invention being used for aligning a set of studs 12. Each stud 12 has a generally elongated configuration defining a pair of longitudinally opposed stud end portions 14.

It should be understood that the runner 10 could be used for aligning studs 12 having any suitable configuration such as the generally "U"-shaped cross-sectional configuration illustrated in FIG. 6, a generally rectangular configuration or any other suitable configuration without departing from the scope of the present invention.

Each runner 10 includes at least two stud receiving components 16. Typically, each runner 10 includes a plurality of adjacent stud receiving components 16. Each stud receiving component 16 is configured and sized for receiving a corresponding stud end portion 14.

Each stud receiving component 16 is provided with a linking means for mechanically linking with an adjacent stud receiving component while allowing the linked stud receiving components to be angled relatively to each other.

Each stud receiving component 16 preferably has a generally concave configuration. In the embodiment illustrated in FIGS. 1 through 7, each stud receiving component 16 has a generally "U"-shaped cross-sectional configuration defining a base wall 20 having a peripheral edge.

Each stud receiving component 16 also has a pair of retaining flanges 22 extending substantially perpendicularly from opposite sides of the peripheral edge of the base wall 20.

Typically, the base wall 20 has a generally rectangular and flat configuration defining a pair of opposed longitudinal edges 24 and a pair of perpendicularly oriented transversal edges 26. The retaining flanges 22 preferably extend integrally from the transversal edges 26.

Each retaining flange 22 has a proximal edge 28 merging with a transversal edge 26, an opposed distal edge 30 and a pair of side edges 32 extending between the proximal edge 28 and the distal edge 30. In a preferred embodiment, each side edge 32 defines a side edge perpendicular segment 34 and an integrally extending side edge angled segment 36.

Each side edge perpendicular segment 34 extends substantially perpendicularly from the base wall 20 while each side edge angled segment 36 extends at an angle from the adjacent side edge perpendicular segment 34 inwardly towards an opposed side edge angled segment 36 part of the same retaining flange 22.

In the preferred embodiment, the linking means 18 includes a membrane 38 extending between adjacent stud receiving component 16. Preferably the membrane 38 is divided into a set of independent strips. Typically, the set of independent strips includes a base strip 40 extending between adjacent base walls 20 and a pair of flange strips 42 extending between the retaining flanges 22 part of adjacent stud receiving components 16. Preferably, the base strips 40 extend between the longitudinal edges 24 of adjacent base walls 20 while the flange strips 42 extend between the side edge perpendicular segments 34 adjacent the side edge angled segments 36 of adjacent retaining flanges 22.

The base strip 40 and the flange strips 42 are configured, sized and made out of a suitable material so as to allow bending thereof. Preferably, the suitable material, the size and the configuration given to the strips 40 and 42 is such that a predetermined force is necessary for modifying the configuration of the membrane 38.

In other words, the configuration and the size of the membrane 38 is customized for a given type of material so that a predetermined force is required for changing the positioning of the stud receiving components 16 relatively to each other.

This feature allows an intended user to give the runner 10 a predetermined configuration by exerting a predetermined force and ensures that the runner 10 will remain substantially in the predetermined configuration. The feature is particularly useful since it allows the runner 10 to be given a predetermined configuration while ensuring that the runner 10 will remain in the predetermined configuration during the following steps leading to the erection of a partition wall such as during the manipulation required for securing the stud end portions 14 in the stud receiving components 16.

In a preferred embodiment, the base strips 40 and the flange strips 42 are made of a generally rectangular configuration that is inwardly bent about a fold line 44 so as to define a generally "V" shaped cross sectional configuration.

As illustrated in FIG. 6, at least some of the retaining flanges 22 may be provided with a fixing aperture 54 extending therethrough. The fixing apertures 54 are configured and sized for allowing insertion therein of conventional fastening components such as screws, nails, bolts or the like. Such conventional fastening components may be used for insertion through both the retaining flanges 22 and the studs 12 so as to further secure the studs 12 in the stud receiving components 16.

Each base strip 40 and each flange strip 42 preferably has a thickness substantially in the range of 1/16", a width substantially in the range of ¾", a length substantially in the range of 1" and is made of galvanized steel, aluminum or the like.

Each runner 10 are preferably integrally formed of a strip of precut and folded material, it would be within the reach of one skilled in the art to design a similar runner wherein the stud receiving components 16 and the linking means are formed independently and assembled together using a conventional method such as spot welding or the like.

Figure 5:
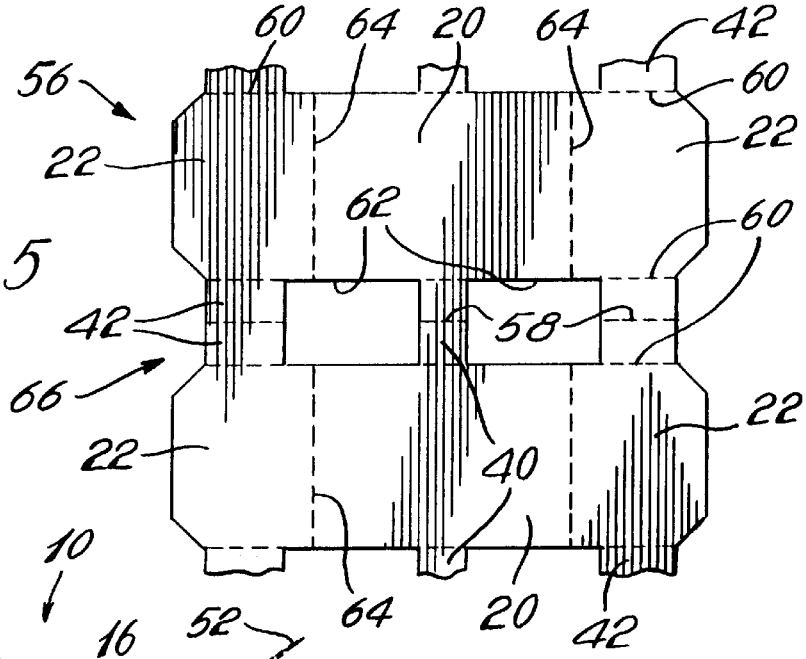
FIG. 5: in a partial top view with sections taken out illustrates part of a blank used for forming a runner in accordance with an embodiment of the present invention.

A blank 56 used for forming two contiguous stud receiving components 16 part of a runner 10 is illustrated prior to folding in FIG. 5. The blank 56 includes a flat sheet of material having a generally rectangular configuration and divided into a pair of symmetrical half sections by a central longitudinal fold line 58 corresponding to the fold line 44.

A lateral longitudinal fold line 60 corresponding to the side edge perpendicular segment 34 extends in a parallel and substantially contiguous relationship to the central longitudinal fold line 58 on each side of the latter. The area delimited by the lateral longitudinal fold lines 60 is provided with a pair of rectangular aperture 62 extending therethrough in a symmetrically spaced relationship relative to each other. The longitudinal edges of the rectangular apertures are in register with the lateral longitudinal fold lines 60.

A transversal fold line 64 corresponding to the transversal edges 26 extends transversally across the blank intercepting the rectangular apertures 62. Each transversal peripheral edge of the blank defines a recess 66 delimited by the lateral longitudinal fold lines 60.

Figure 1:
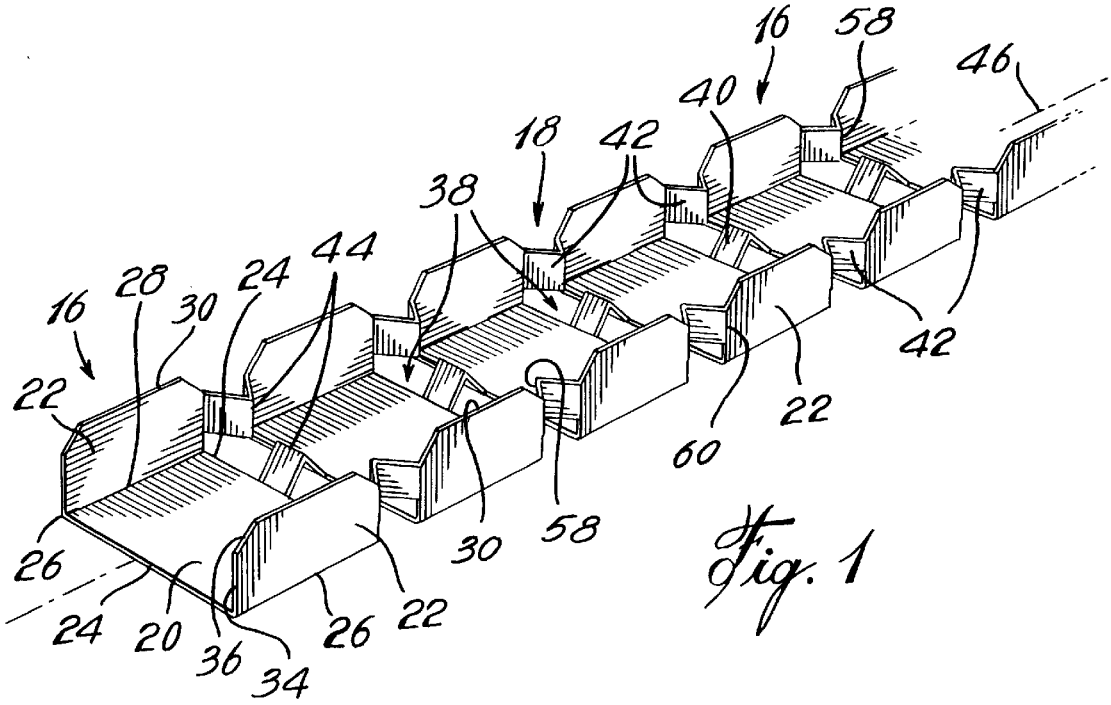
FIG. 1: in a partial perspective view with sections taken out illustrates a runner in accordance with an embodiment of the present invention.
Figure 2:
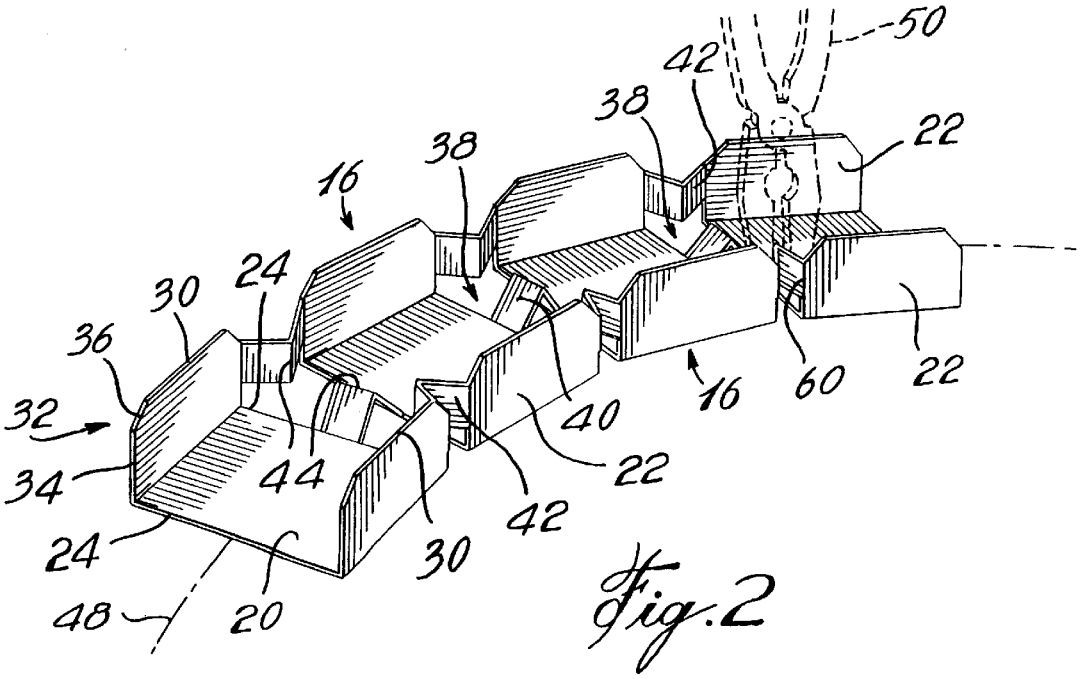
FIG. 2: in a partial perspective view with sections taken out illustrates the runner of FIG. 1 in the process of being bent in a laterally bent configuration.
Figure 3:
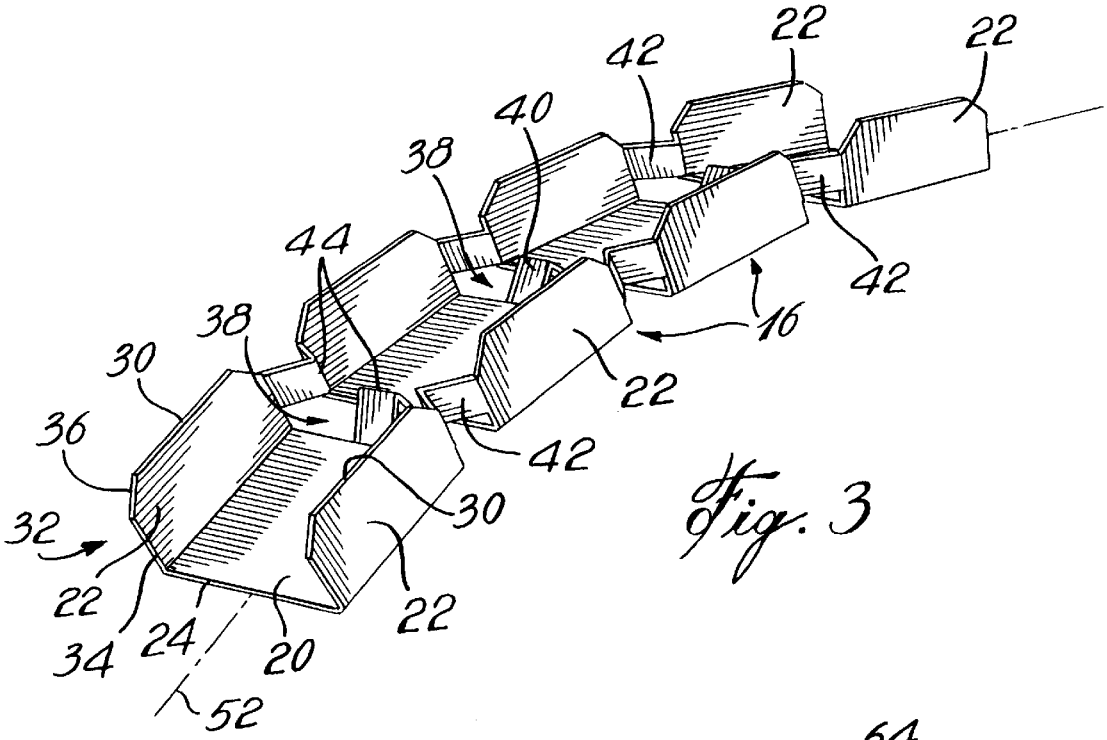
FIG. 3: in a partial perspective view with sections taken out illustrates the runner of FIG. 1 in a downwardly bent configuration.
Figure 4:
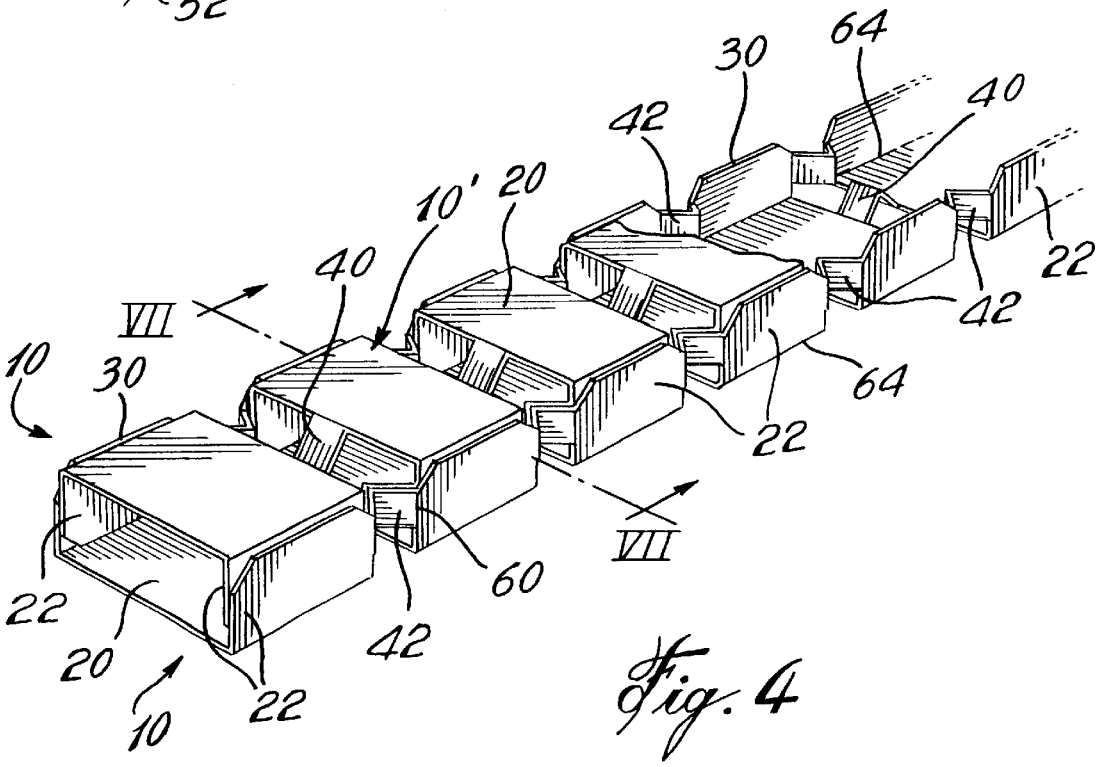
FIG. 4: in a partial perspective view with sections taken out illustrates a pair of runners in accordance with an embodiment of the present invention in a superposed relationship relative to each other.

The runner 10 is adapted to be used in either a relatively straight configuration as illustrated in FIGS. 1 and 4 or in one of a multitude of bent configurations some of which are given as example in FIGS. 2, 3, 6 and 7. When the runner 10 is in a relatively straight configuration, as illustrated in FIG. 1, the stud receiving components 16 are aligned so as to form a generally rectilinear runner longitudinal axis 46.

When a curved wall frame needs to be erected, the runner 10 may be laterally bent so that the stud receiving components 16 define a generally laterally bent runner longitudinal axis 48 as illustrated in FIG. 2. In order to bend the runner 10 laterally, an intended user merely needs to bring the side edges 32 of adjacent stud receiving components 16 positioned inwardly relatively to the radius of curvature in a relatively proximal relationship relatively to one another while spacing the side edges 32 of adjacent stud receiving components 16 positioned outwardly relatively to the center of the radius of curvature.

The inwardly positioned side edges 32 may be brought in a proximal relationship relatively to one another by squeezing the corresponding flange strips 42. This operation can be easily performed using a set of conventional pliers 50 as illustrated in FIG. 2.

When the upper or lower peripheral edge of a wall needs to be given a generally arcuate configuration in a planner direction, the stud receiving components 16 may be positioned so as to define a generally planarly bent runner longitudinal axis 52 as illustrated in FIG. 3. The planarly bent configuration is particularly suitable in situations wherein the distance between floor and ceiling varies. The planarly bent configuration may also be useful in a variety of other situations such as when the runner 10 is planarly bent about 360 degrees so as to form the framing of an arcuatly shaped window opening, columns or the like.

Figure 7:
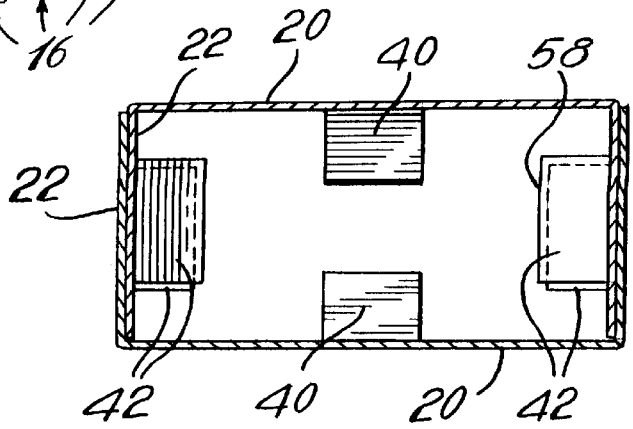
FIG. 7: in a cross-sectional view taken along arrows VII—VII of FIG. 4 is a top plan view of the runner of FIG. 1 used to create a circular enclosure.

In order to form the configurations illustrated in FIGS. 3 and 7, an intended user merely needs to bend the runner 10 so that the peripheral edges of adjacent base walls 20 are brought in a proximal relationship relatively to one another. The base strips 40 are thus bent while the specific configuration of the flange strips 40 allow for the bending action of the base strips 40. In this configuration, the flange strip half sections part of the inwardly positioned flange strips are brought in proximal relationship relatively to one another while the outwardly positioned flange strips 42 are opened up so that the respective flange strip half sections are spaced apart relatively to one another.

It should be understood that the runner 10 could be given any suitable configuration by changing the angular relationship between adjacent stud receiving components 16. For example, FIG. 6 illustrates the situation wherein the upper and lower runners 10 are both laterally and planarly bent.

The specific configuration of the preferred embodiment of the stud receiving components 16 is adapted to facilitate the alignment of a pair of runners 10 and 10' used jointly to built a given wall structure. It is thus possible to create a floor runner having a configuration substantially identical to a corresponding ceiling runner. In order to ensure that both the runners 10 and 10' have substantially identical configurations, an intended user first configures one of the runners according to a predetermined pattern.

The runner 10 is then used as a guide for configuring the second runner 10'. The retaining flanges 22 of the second runner 10' are squeezed inwardly so that the second runner 10' may be partially inserted within the concavities formed by the first runner 10 as illustrated in FIGS. 4 and 7. The intersections of the retaining flanges with the side edge angled segment 36 forms a guiding and obstructing structure against which abutment will occur. The specific configuration of the preferred embodiment of the side edges 32 thus provides for an abutment means that is used for mattingly configuring a pair of jointly working runners 10 and 10'.

The embodiments of the invention in which an exclusive privilege or property is claimed are defined as follows:

1. A runner for maintaining at least two studs in a predetermined relationship relatively to one another, each of said studs having a generally elongated configuration defining a pair of longitudinally opposed stud end portions, said runner comprising:

at least two stud receiving components disposed along a first axis, each of said stud receiving components having a pair of retaining flanges extending from opposed sides of a base wall for receiving one of said stud end portions; each pair of adjacent stud receiving components being provided therebetween with a linking means for mechanically linking said pair of adjacent stud receiving components thereby forming linked stud receiving components while allowing the linked stud receiving components to be selectively angled relatively to each other about two distinct bending axes, wherein said stud receiving components and said linking means are integrally formed from a sheet of material, and wherein said linking means include at least one set of bendable strips extending between adjacent stud receiving components, said at least one set of bendable strips being formed by a row of spaced-apart apertures defined through said sheet of material along a second axis transversal to said first axis, said row of spaced-apart apertures including at least two substantially rectangular elongated apertures having longitudinal axes thereof parallel to said second axis, each of said at least two elongated apertures having a major portion thereof disposed between adjacent base walls and inwardly of said retaining flanges, said at least two elongated apertures being spaced by a distance which is smaller than a length thereof, thereby allowing for substantially small bendable strips between adjacent base walls for facilitating a deformation of said runner.

2. A runner as recited in claim 1 wherein at least one of said at least two stud receiving components has a generally concave configuration.

3. A runner as recited in claim 2 wherein said at least one stud receiving component has a generally U-shaped cross-sectional configuration, said base wall having a base wall peripheral edge; and wherein said pair of retaining flanges extend substantially perpendicularly from opposite sides of said base wall peripheral edge.

4. A runner as recited in claim 3 wherein said base wall has a generally rectangular and flat configuration defining a pair of opposed longitudinal edges and a pair of transversal edges perpendicularly oriented relatively to said longitudinal edges, said retaining flanges extending integrally from said transversal edges.

5. A runner as recited in claim 4 wherein each of said retaining flanges has a proximal edge merging with one of said transversal edges, an opposed distal edge and a pair of side edges extending between said proximal edge and said distal edge.

6. A runner as recited in claim 5 wherein each side edge defines a side edge perpendicular segment and an integrally extending side edge angled segment; each side edge perpendicular segment extending substantially perpendicularly from said base wall while each side edge angled segment extends at an angle from said adjacent side edge perpendicular segment inwardly towards an opposed side edge angled segment of the same retaining flange.

7. A runner as recited in claim 1 wherein said set of bendable strips includes a base strip extending between base walls of adjacent stud receiving components.

8. A runner as recited in claim 7 wherein said set of bendable strips further includes a pair of flange strips extending between retaining flanges of adjacent stud receiving components.

9. A runner as recited in claim 8 wherein said base strip extends between respective longitudinal edges of adjacent base walls while said flange strips extend between respective side edge perpendicular segments adjacent a corresponding side edge angled segment of adjacent retaining flanges.

10. A runner as recited in claim 8 wherein at lest one of said base strip and said flange strips is made of a generally rectangular configuration that is inwardly bent about a fold line so as to define a generally V-shaped cross sectional configuration.

11. A runner as recited in claim 10 wherein at least one of said base strip and said flange strips has a thickness substantially in a range of 1/16", a width substantially in a range of ¾", a length substantially in a range of 1", and wherein said base and flange strips are made of galvanized steel.

12. A runner as recited in claim 9 wherein the intersections of said retaining flanges with said side edge angled segment forms an obstructing structure; whereby said obstructing structure is used for matingly configuring a pair of jointly working runners.

13. A runner as recited in claim 3 wherein at least one of said retaining flanges has a fixing aperture extending therethrough.

14. A runner as recited in claim 1 wherein each of said apertures has a longitudinal axis, said longitudinal axis being parallel to said second axis.

15. A blank for use in forming a pair of serially interconnected stud receiving components, comprising a flat sheet of bendable material, a pair of parallel fold lines defining therebetween a base wall and along which opposed lateral portions of the sheet can be folded to form a pair of opposed side walls, and a set of spaced-apart apertures defined through said sheet of bendable material along an axis transversal to said fold lines to leave corresponding bendable tongues of material in said base wall and said opposed side walls, said set of spaced-apart apertures including at least two substantially rectangular elongated apertures having longitudinal axes thereof parallel to said axis, each of said at least two elongated apertures having a major portion thereof extending in said base wall and inwardly of said fold lines, said at least two elongated apertures being spaced by a distance which is smaller than a length thereof, thereby providing substantially small bendable tongues in said base wall.

16. A blank as recited in claim 15 wherein each of said apertures has a longitudinal axis, said longitudinal axis being perpendicular to said fold lines.

17. A blank as recited in claim 16 wherein said set of apertures includes a pair of rectangular apertures respectively intersected by a corresponding one of said fold lines.

18. A blank for use in forming a pair of serially interconnected stud receiving components, comprising a flat sheet of bendable material, a pair of parallel fold lines defining therebetween a base wall and along which opposed lateral portions of the sheet can be folded to form a pair of opposed side walls, and at least two sets of substantially rectangular spaced-apart elongated apertures defined through said sheet of bendable material along an axis transversal to said fold lines to leave corresponding bendable tongues of material in said base wall and said opposed side walls, wherein adjacent sets of spaced-apart elongated apertures are spaced by a distance which is smaller than that separating said fold lines, said set of spaced-apart apertures including at least two elongated apertures extending along said axis, each of said at least two elongated apertures having a major portion thereof extending in said base wall and inwardly of said fold lines, said at least two elongated apertures being spaced by a distance which is smaller than a length thereof.

* * * * *